United States Patent [19]

Gary et al.

[11] Patent Number: 5,037,452

[45] Date of Patent: Aug. 6, 1991

[54] METHOD OF MAKING VITREOUS BONDED GRINDING WHEELS AND GRINDING WHEELS OBTAINED BY THE METHOD

[75] Inventors: Roger A. Gary, Loveland; Soo. C. Yoon, Cincinnati, both of Ohio

[73] Assignee: Cincinnati Milacron Inc., Cincinnati, Ohio

[21] Appl. No.: 631,140

[22] Filed: Dec. 20, 1990

[51] Int. Cl.[5] ..... B24D 3/16; B24D 3/30; B24D 5/02

[52] U.S. Cl. ..... 51/293; 51/298; 51/302; 51/307; 51/309

[58] Field of Search ..... 51/298, 293, 307, 309

[56] References Cited

U.S. PATENT DOCUMENTS 4,920,704 5/1990 Caserta et al. ..... 51/302

*Primary Examiner*—William R. Dixon, Jr.
*Assistant Examiner*—Margaret V. Einsmann
*Attorney, Agent, or Firm*—John W. Gregg; Donald Dunn

[57] ABSTRACT

A method for making vitreous bonded abrasive articles, particularly grinding wheels, is provided that includes the step of blending sugar/starch particles into the other ingredients for making the wheel. The sugar/starch particles are intimate combinations of sugar and starch. Wheels of improved performance are obtained compared to similar wheels made by a comparable method not including the step of blending sugar/starch particles into the abrasive grain, vitreous bond material and other components used for making the wheel.

12 Claims, No Drawings

METHOD OF MAKING VITREOUS BONDED GRINDING WHEELS AND GRINDING WHEELS OBTAINED BY THE METHOD

FIELD OF THE INVENTION

This invention pertains to a method of producing vitreous bonded abrasive articles, particularly grinding wheels, and to the abrasive articles obtained by the method. In the method of the invention sugar/starch particles are blended with the other ingredients of the abrasive article, e.g. abrasive grit, vitreous bond, temporary binder, etc., prior to the steps of press forming and firing the article.

DESCRIPTION OF THE RELATED ART

Vitreous bonded abrasive grinding wheels and other abrasive articles have been known in the art for a long time. Such wheels and articles continue, however, to be the subject for improvement in both materials and procedures for their manufacture, as well as increased grinding performance, higher utility, greater life and advantageous economics. Improved abrasive grains and methods for their production, as well as improvements in the composition and properties of the vitreous bond materials are regularly brought into the art. Such improvements have resulted in greater grinding performance, lower cost, improved work products and greater wheel life in many cases. However, advances in utility and performance continue to be sought, particularly as advances in technology place ever greater demands on precision, accuracy and performance of devices and their ground component parts and increased competition places ever greater emphasis on economic advantages in wheel performance and grinding operations.

Essentially, a vitreous bonded grinding wheel has abrasive grain or grit, e.g. alumina abrasive, bonded together by a vitreous material formed and/or fused during the firing step of the wheel manufacture. Other materials, such as, for example, solid lubricants, sometimes are included in the wheel during the course of its production. In the typical method of making a vitreous bonded grinding wheel, in the art, the abrasive grain, bond material, e.g. frit or other vitrifiable materials, temporary binder and sometimes other materials, e.g. lubricants and pore inducers, are blended together to form a uniform mixture. This mixture is then placed in a mold of the general size and shape of the desired grinding wheel. The mixture in the mold is then pressed to compact it into a temporary self-supporting shape held together by the temporary binder, e.g. an aqueous phenolic resin binder. This temporarily bound, i.e. green wheel, is dried and then placed in a kiln to be heated, i.e. fired, under a particular cycle of time and temperature to burn off the temporary binder and any pore inducer present and to vitrify the bond material. The heating cycle depends on the composition of the grinding wheel. Thus, it may vary with the abrasive grain and/or the composition of the vitreous bond. In the first step, it is known to use an inert atmosphere (e.g. nitrogen) to reduce or prevent oxidation or other undesirable reactions that may be obtained during firing in an air atmosphere. Thus, the method of manufacture of the vitreous bonded grinding wheel includes the step of physically combining various permanent and temporary ingredients. The permanent ingredients show up in the composition of the finished wheel, whereas the temporary ingredients are lost during the firing step and thus would not show up in the finished wheel. These temporary materials can, and often do, have a significant effect on the structure, properties and grinding performance of the wheel. For example, temporary pore producing organic materials such as dichlorobenzene and ground nut shells have been used to create and determine the pores in grinding wheels.

Vitreous bonded grinding wheels are made, in the art, in various grades to optimize the properties, economics and performance to the grinding operation (i.e., the workpiece shape, size and composition as well as grinding conditions such as wheel speed, infeed rates and depth of cut). These various grades may be obtained by changes in the composition, physical properties, structure and/or method of manufacture of the wheel. Thus, for example, the particular method, including the specific conditions under which the wheel is made, can change with the grade of the wheel. Wheel structure and performance therefore can in large measure be determined by the method of manufacture of the wheel. Vitreous bonded grinding wheels are well known to contain voids, i.e. pores, and it is also known that the number and/or size of these pores can vary with the grade of the wheel and in large measure determine the structure of the wheel. Generally, the larger the pores and/or the greater the number of pores, the softer, i.e. weaker, is the wheel. Conversely, in a general sense, the smaller the pores and/or the lesser the number of pores, the harder, i.e. stronger, the wheel. These pores can result from entrained air and/or pore inducers volatilized during firing of the wheel. Thus, vitreous bonded grinding wheels can be broadly classified from soft to hard depending on their porosity. structure and grinding action. Soft wheels tend to wear fast and exhibit a weak structure. Such wheels have rapid breakdown and loss of abrasive grain during grinding resulting in their use at slow speeds and under relatively mild grinding conditions. Hard wheels, on the other hand, exhibit slower wear, resistance to breakdown, and high physical strength. These wheels find optimum use a) at high speeds, b) for grinding harder metals and alloys, (c) in precision grinding, and d) under severe grinding conditions (e.g., high infeed, high force conditions).

The vitreous bonded grinding wheels having a high pore content, usually characterized as soft wheels, become increasingly more difficult to reliably make as the pore content of the wheel increases. Such difficulty principally arises from the decreasing strength of the wheel before and during firing as the pore content of the wheel increases. As the pore content of these high porosity wheels increases, the amount of abrasive grain and vitreous bond in the wheel decreases thereby resulting in a decrease in the strength of the wheel. In prior art methods of making such wheels, this loss in strength is manifested by a weakness of the wheel after the pressing step and a sagging of the wheel during the firing step. These problems were addressed and solved by the applicant's assignee, resulting in the development of a process including a step of blending sugar/starch particles with the other ingredients, i.e. components, of the wheel, followed by the steps of placing the blend of the wheel ingredients in a mold, compressing the blend, removing the compressed blend, i.e. green wheel, from the mold and firing the wheel in a kiln to vitrify the bond. This process reliably produced high porosity, i.e. soft, vitreous bonded grinding wheels and overcame the problems associated with the prior methods for making such wheels.

To assist in understanding the variation of vitreous bonded grinding wheel grades, and to better understand the process developed above in relation to those grades and the invention described and claimed herein, the grade of a vitreous bonded grinding wheel may be identified by a Wheel Structure Index (WSI). This index is based upon the bulk density of the abrasive (BD), the true density of the abrasive grain (TD), the volume fraction (f) of the abrasive grain in the total abrasive grain component of the wheel and the grain volume fraction (GVF) of the wheel. The Wheel Structure Index value is arrived at in accordance with the following general formula.

$$WSI = (GVF)_t / \sum_{n=1}^{10} (f_n)[(BD)_n/(TD)_n]$$

where $(GVF)_t$ is the total grain volume fraction for the wheel and is equal to the total volume of abrasive grain divided by the volume of the vitreous bonded abrasive wheel, $f_n$ is the volume fraction of a given abrasive grain in the total abrasive grain component of the wheel, $(BD)_n$ is the bulk density of the abrasive grain of $f_n$ volume fraction, and $(TD)_n$ is the true density of the abrasive grain of $f_n$ volume fraction.

$$\sum_{n=1}^{10} (f_n)[(BD)_n/(TD)_n] = (f_1)[(BD)_1/(TD)_1] + (f_2)[(BD)_2]/(TD)_2] + \ldots + (f_{10})[(BD)_{10}/(TD)_{10}]$$

where $f_1$ is the volume fraction of grain number 1, $f_2$ is the volume fraction of grain number 2, $f_{10}$ is the volume fraction of grain number 10, $(BD)_1$ is the bulk density of grain number 1, $(BD)_2$ is the bulk density of grain number 2, $(BD)_{10}$ is the bulk density of grain number 10, $(TD)_1$ is the true density of grain number 1, $(TD)_2$ is the true density of grain number 2, $(TD)_{10}$ is the true density of grain number 10, The value of $(GVF)_t$ is arrived at by determining the total volume of abrasive grain in the wheel and dividing that volume by the volume of the wheel. In calculating the total volume of abrasive grain in the wheel, the weight of each type of abrasive grain is divided by the true density of that grain to give the volume of that grain in the wheel. Each of these volumes of abrasive grain are added together to give the total volume of abrasive grain. For example, in a vitreous bonded grinding wheel having aluminum oxide and silicon carbide abrasive grains, the total volume of abrasive grain would be arrived at by dividing the weight of aluminum oxide grain in the wheel by the true density of the aluminum oxide grain to give the volume of that grain in the wheel. Correspondingly, the weight of silicon carbide abrasive grain is divided by the true density of silicon carbide grain to give its volume in the wheel. Adding these volumes of aluminum oxide and silicon carbide grains together gives the total volume of abrasive grain in the wheel. Volume fraction (f) of a given abrasive grain is obtained by determining the volume of that grain used in the wheel and dividing that volume by the total volume of the abrasive grain. The determination of the total volume of abrasive grain in the wheel has been described above. Dividing the total volume of the abrasive grain into the volume of each type of abrasive grain gives the volume fraction (f) for each type of abrasive grain in the wheel.

The calculation of WSI can be further described by way of the following example for a vitreous bonded aluminum oxide grinding wheel, wherein the bulk density (BD) of the aluminum oxide abrasive grain is 1.70 gm/cc and the true density of the same grain is 4.00 gm/cc. Since a single type of abrasive grain is used in the wheel of this example, the value of (f) is one. In this example, $(GVF)_t$ has a value of 0.48. Thus, $$WSI = 0.48/(1.70/4.00)$$

$$WSI = (0.48)(4.00)/1.70$$

$$WSI = 1.129$$

The high porosity, i.e. soft, vitreous bonded abrasive grinding wheels previously developed by the applicant's assignee in accordance with the above-described method had a WSI of one or less.

The physical weakness before and during firing of high porosity. i.e. soft, wheels, which is a problem in the art methods of making soft wheels, does not appear to exist in the art methods of making low porosity, i.e. hard, wheels because of the larger amount of bond and abrasive grain in such wheels. Thus, art methods are known to reliably make low porosity vitreous bonded grinding wheels. However, the low porosity wheels produced by the methods of the art exhibit less than desirable performance during grinding, particularly during the grinding of tough metals. These low porosity wheels have a WSI of greater than one. It was an object of the work leading to the invention described and claimed herein to overcome the less than desirable grinding performance of low porosity, i.e. hard, vitreous bonded grinding wheels produced in accordance with prior art methods.

SUMMARY OF THE INVENTION

It is an object of this invention to provide an improved method for making vitreous bonded abrasive articles, e.g. grinding wheels.

Another object of this invention is to provide a method for making vitreous bonded abrasive grinding wheels having improved performance.

A further object of this invention is to provide vitreous bonded abrasive grinding wheels of high structural uniformity.

A still further object of this invention is to overcome many of the structure and performance disadvantages of prior art vitreous bonded grinding wheels.

These and other objects of this invention will be made clear in the following description, examples and claims. The above objects and others, as will be apparent from the following description and claims, are achieved in this invention in a method of making an improved vitreous bonded abrasive article, having a Wheel Structure Index greater than one, comprising the steps of a) blending sugar/starch particles into the abrasive grain, vitreous bond materials and other ingredients for making the wheel, b) placing this mixture in a mold, c) compressing the mixture in the mold, d) removing the compressed mixture from the mold, and e) firing the compressed mixture to vitrify the bond material.

DESCRIPTION OF INVENTION

There is now provided in accordance with this invention a method of making vitreous bonded abrasive articles having a Wheel Structure Index of greater than one, more especially vitreous bonded grinding wheels, comprising the steps of a) blending together, at a Wheel Structure Index of greater than one, abrasive grains, vitreous bond materials and temporary binder to form a uniform mixture, b) placing the mixture in a mold, c) compressing the mixture in the mold to the general size and shape of the article, d) removing the compressed mixture from the mold, and e) firing the compressed mixture to form the vitreous bonded abrasive article, characterized by the step of blending sugar/starch particles into the mixture for forming the article.

In the practice of this invention, variations may be employed to produce the vitreous bonded grinding wheels, having a WSI greater than one, of improved grinding performance without departing from the scope and spirit of the invention described and claimed herein. As one practice of the method of this invention, there may be employed, at a WSI of greater than one, the steps of a) blending together the abrasive grains and a temporary binder, e.g. a phenolic resin binder, until a uniform coating of the abrasive grain by the binder is achieved, b) adding a vitreous bond material to the binder coated grain while blending and continuing blending until a uniform mixture is obtained, c) adding sugar/starch particles to the mixture of step (b) with blending and continue blending until a uniform mixture is produced, d) screening the mixture produced in step (c) to remove undesirable lumps, e) weighing the screened mixture into a mold of the general size and shape of the wheel to be produced, f) pressing the mixture in the mold, g) removing the pressed mixture from the mold, h) drying the pressed mixture, and j) firing the dried pressed mixture to bond together the abrasive grains. Each of the steps (a), (b), (d), (e), (f), (g), (h), and (j) above, are common to the prior art. However, in grinding wheels having a WSI greater than one, step (c) above in this invention, is not in accordance with the prior art.

In another practice of the method of this invention, the vitreous bonded abrasive article of a WSI greater than one may be produced by the use of two or more different types of abrasive grains. That is, two or more abrasive grains having different physical and/or chemical structures, e.g. aluminum oxide and silicon carbide, may be thoroughly blended together prior to the step of blending together the abrasive grain and temporary binder as described above. The remaining steps (a) through (j) remain the same as described above.

The practice of the method of this invention may also include the step of blending together various sizes of abrasive grains of the same composition, e.g. various sizes of aluminum oxide grains, prior to the step of blending together the abrasive grain and the temporary binder.

A still further practice of this invention may include a) blending together abrasive grain and a temporary binder until a uniform coating of the grain by the binder is obtained, b) blending together the vitreous bond material and sugar/starch particles to obtain a uniform mixture, c) blending together the binder coated abrasive grain from step (a) and the mixture resulting from step (b) to form a uniform blend, d) adding the blend from step (c) to a mold of the general size and shape of the abrasive article to be produced, e) compressing the blend in the mold, f) removing the compressed blend from the mold, g) drying the compressed blend, and h) firing the compressed blend to bond together the abrasive grains.

There may be used in the practice of this invention various abrasive grains of conventional sizes, singly or in combination, including but not limited to fused alumina, sol-gel alumina, silicon carbide, tungsten carbide, cubic boron nitride, boron carbide, diamond and aluminum nitride. Vitreous bond compositions well-known in the art may be used including frit and blends of powdered inorganic vitreous bond forming compounds and minerals. Temporary binders known in the art, whether organic or inorganic, may be employed in this invention in well-known amounts, such as for example, aqueous phenolic resin compositions and aqueous paraffin wax emulsions. Substances aiding in the manufacturing of grinding wheels may be included in the practice of the method of this invention. Although it has not been found necessary to use grinding aids in the manufacture of the grinding wheels in the practice of the method of this invention, such aids may be utilized.

In accordance with this invention, the vitreous bonded abrasive article is required to have a WSI greater than one. In a preferred practice of this invention, the vitreous bonded abrasive article has a WSI greater than one and not greater than two. More preferably the vitreous bonded abrasive article has a WSI in the range of from greater than 1.00 to 1.70.

This invention provides a method for making highly uniform vitreous bonded grinding wheels, of WSI greater than one, having improved grinding performance over comparable grinding wheels made by a similar prior art method not using the sugar/starch particles of the method of this invention. Not only has improved grinding performance been observed for grinding wheels made in accordance with this invention over comparable prior art wheels, but there has also been observed greater structural uniformity in the wheel produced in accordance with the method of this invention over wheels of comparable WSI produced by prior art methods not using the sugar/starch particles as in accordance with this invention.

Grinding wheels produced by the method of this invention are useful in the grinding of steel workpieces and may be of conventional sizes and shapes found in the art.

It has been unexpectedly found that vitreous bonded abrasive grinding wheels having a WSI greater than one and exhibiting improved performance, more especially grinding performance, over comparable wheels made by prior art methods, can be produced by a method wherein sugar/starch particles are blended into the ingredients for forming the wheel. No evidence has been found for the presence of the sugar/starch particles in the finished grinding wheel and they are, therefore, believed to be absent from the finished vitreous bonded grinding wheel, at least in the form in which they were blended into the ingredients for forming the wheel. The sugar/starch particles employed in accordance with the method of this invention may exhibit a wide range of compositions. The ratio of sugar to starch may vary over a wide range. These particles may also contain other substances in intimate blend with the sugar and starch components of the particle. There occurs in these particles an intimate physical and/or chemical combination of sugar and starch to form single particles. Separate particles of sugar and starch physically blended together are not employed in the practice of this invention. The sugar/starch particle may have a ratio of sugar to starch in the range of from 50/50 to 90/10 by weight. Preferably, the ratio of sugar to starch is in the range of from 70/30 to 85/15 by weight.

Sugar/starch particles having a size in the range of from 100 to 10 mesh, i.e. particles having the largest dimension in the range of from 0.15 millimeters to 2.00 millimeters, with a preferable range of from 50 mesh to 16 mesh, i.e. largest dimension from 0.30 to 1.18 millimeters, may be employed in the practice of this invention. There may be used an amount of the sugar/starch particles equal to from 1.0% to 15% of the weight of the abrasive grain in the abrasive article. In a preferred practice of the invention, there may be used an amount of the sugar/starch particles equal to from 2.0% to 10.0% of the weight of the abrasive grain in the abrasive article.

Conventional blending and mixing techniques, conditions and equipment, well-known in the art, may be employed to practice the method of this invention. Techniques, conditions and equipment well-known in the art for pressing vitreous bonded abrasive articles, e.g., grinding wheels, prior to firing of the article may be used. Drying of the pressed vitreous bonded abrasive article prior to firing may be used to remove water or organic solvents usually introduced into the article with the temporary binder component and may be carried out using techniques, conditions and equipment well-known in the art. After drying, the pressed abrasive article, usually termed the green article or wheel, is subjected to high temperatures, e.g., 1000° F. to 2500° F., to form the vitreous bond holding together the abrasive grain. This firing step is usually carried out in a kiln where the atmosphere, temperature and the time the article is heated are controlled or variably controlled according to such factors as the size and shape of the article, the composition of the vitreous bond and the nature of the abrasive grain. Firing conditions well-known in the art may be used in the practice of this invention.

This invention will now be further described in the following non-limiting examples wherein, unless otherwise specified, the amounts of materials are by weight, temperature is in degrees Fahrenheit and 1) the CUBITRON MLM Sol-Gel Alumina Abrasive is in accordance with the disclosure and claims of U.S. Pat. No. 4,744,802 issued May 17, 1988 and was obtained from the Minnesota Mining and Manufacturing Company (CUBITRON is a registered trademark of the Minnesota Mining and Manufacturing Company);

2) Bond A has a mole % oxide based composition of $SiO_2$ 63.28; $TiO_2$ 0.32; $Al_2O_3$ 10.99; $Fe_2O_3$ 0.13; $B_2O_3$ 5.11; $K_2O$ 3.81; $Na_2O$ 4.20; $Li_2O$ 4.48; CaO 3.88; MgO 3.04 and BaO 0.26;

3) Bond B has a mole % oxide based composition of $SiO_2$ 47.34., $TiO_2$ 0.40; $Al_2O_3$ 41.79; $Fe_2O_3$ 0.08; $K_2O$ 2.25; $Na_2O$ 2.25., $Na_2O$ 1.13; CaO 2.25; and MgO 4.75;

4) 3029 UF Resin is a 65% by weight urea formaldehyde resin 35% by weight water composition;

5) T-1 is a 70/30 by weight dry blend of urea formaldehyde powdered resin and corn starch;

6) VINSOL is a pine resin obtained from Hercules Inc. (VINSOL is a registered trademark of Hercules Inc.); and 7) CRUNCHLETS CR 20 are sugar/starch particles having a weight ratio of sugar to starch of 78.5 to 21.5 and a particle size in the range of from greater than 0.354 millimeters to less than 1.19 millimeters. CRUNCHLETS is a registered trademark of Custom Industries Inc.

The components of the formulations in the examples below were combined in the following manner, in accordance with the percentages listed. Where two or more abrasive grains of different chemical composition, physical structure or size were used, they were blended together prior to the following steps. The abrasive grain, 3029 UF Resin and ethylene glycol (where used) were blended together until uniform coating of the abrasive grain was achieved. To the resulting mixture, was added a combination of the bond blend, dextrin powder and T-1 (where used) with mixing and mixing continued until a uniform mixture was obtained. VINSOL (where used) was then added to the mixture with agitation. This was followed by the addition of the CHUNCHLETS CR 20 particles with agitation until a uniform blend was produced. The resulting composition was then screened to remove undesirable lumps and a predetermined amount of the screened mix was placed in a steel mold of the shape and approximate size of the grinding wheel to be produced. The mold was nominally 14.5×0.60×4.905 inches. After uniformly distributing the blend in the mold, it was cold pressed to compact the blend to the 14.5×0.60×4.905 inches dimensions. The compacted blend, i.e. green wheel, was then removed from the mold and subjected to a drying cycle by heating the green wheel from room temperature to 275° F. for 13 hours and then ambient air cooling it to room temperature. This dried green wheel was then given a firing cycle in accordance with the conditions described in the examples. The resulting wheels were then finished to their final size (14×0.50×5.00 inches).

EXAMPLES

| | Example Number | | | |
|---|---|---|---|---|
| Component | 1 | 2 | 3 | 4 |
| CUBITRON MLM (60 grit) | 41.4 | 42.8 | 20.7 | 21.4 |
| Fused Alumina 9A (60 grit) | 41.4 | 42.8 | 62.1 | 64.2 |
| 3029 UF Resin | 2.3 | 2.0 | 2.3 | 2.0 |
| Bond A | 9.9 | 10.3 | 9.9 | 10.3 |
| Dextrin | 2.5 | 1.7 | 2.5 | 1.7 |
| Ethylene glycol | 0.3 | | 0.3 | |
| T-1 | | 0.3 | | 0.3 |
| CRUNCHLETS CR 20 | 2.1 | | 2.1 | |

Examples 1 to 4 were given a firing cycle in air of from room temperature to 1650° F. over 11 hours, held at 1650° F. for 12 hours, heated from 1650° F. to 2100° F. over 6.5 hours and held at 2100° F. for three hours. The wheels were then cooled in ambient air to room temperature over 27.5 hours. Wheels produced according to Examples 1 to 4 had a WSI of 1.115. All of the amounts in the above table are in % by weight.

Tests were conducted on grinding wheels produced in accordance with the above Examples, to evaluate grinding performance of the wheels. using the following procedure and conditions. The 14×0.5×5.00 inch wheels were mounted on a Universal Center type grinder and plunge grinding performed on a rotating (200 surface feet per minute) 4×0.20×1.25 inch 4145 steel cylindrical workpiece at a wheel speed of 1718 RPM, and infeed rates of 0.0417 inches/minute, 0.0625 inches/minute and 0.0833 inches/minute. CIMSTAR 40 metalworking fluid was used during each test (CIMSTAR is a registered trademark of Cincinnati Milacron Inc.) Each test was conducted to remove 0.500 inches off the diameter of the workpiece. Measurements were made of wheel wear and metal removed from the workpiece for each test and the G-Ratio computed. G-Ratio is the volume of metal removed per unit volume of wheel wear.

The following results were obtained in tests conducted in accordance with the above procedure.

| Example Number | Infeed Rate* | G-Ratio |
|---|---|---|
| 1 | A | 37.56 |
| | B | 27.93 |
| | C | 22.67 |
| 2 | A | 24.81 |
| | B | 20.69 |
| | C | 12.64 |
| 3 | A | 38.48 |
| | B | 28.88 |
| | C | 21.66 |
| 4 | A | 25.97 |
| | B | 16.83 |
| | C | 11.43 |

A comparison of the G-Ratio values for Example 1 vs. Example 2, and Example 3 vs. Example 4, shows that at each of the infeed rates, the wheels made in accordance with the method of the invention, wherein there is used a step of blending sugar/starch particles into the ingredients for making a wheel having a WSI greater than 1.0, i.e. Examples 1, and 3, exhibit a significantly higher G-Ratio, and therefore, significantly higher grinding performance than comparable wheels made by a comparable process not using a step of blending sugar/starch particles into the ingredients for making the wheel (i.e., Examples 2, and 4). Thus, for instance, the G-Ratio of 37.56 for Example 1, at the 0.0417 inches/minute infeed rate, vs. the G-Ratio of 24.81 for Example 2, at the same infeed rate, represents a greater than 50% increase in grinding performance for the wheel produced in accordance with the method of this invention (Example 1) over a comparable wheel produced by a comparable method not employing the step of blending sugar/starch particles into the ingredients for making the wheel (Example 2).

What is claimed is:

1. A method for producing a vitreous bonded abrasive article, having a Wheel Structure Index in the range of 1.10 to 2.00, comprising the steps of (a) blending together abrasive grain, vitreous bond material and temporary binder components, in any order, to form a uniform mixture;

(b) placing the mixture in a mold;

(c) compressing the mixture in the mold; and (d) firing the compressed mixture to bond the abrasive grains together, wherein the improvement comprises the step of blending, in any order, sugar/starch particles with the components for making the article, in an amount ranging from 1.0% to 15.0% by weight based on the weight of the abrasive grain, prior to the step of placing the mixture in a mold and wherein the sugar/starch particles have a size in the range of from 0.15 millimeters to 2.00 millimeters.

2. The method according to claim 1 wherein the sugar/starch particles into a mixture of abrasive grains, vitreous bond material and temporary components.

3. The method according to claim 1 wherein the sugar/starch particles have a ratio of sugar to starch of from 50/50 to 90/10 by weight.

4. The method according to claim 3 wherein the ratio of sugar to starch is in the range of from 70/30 to 85/15 by weight.

5. A method according to claim 1 wherein the sugar/starch particles have a size in the range of from 0.30 to 1.18 millimeters.

6. The method of claim 1 wherein said amount ranges from 2.0% to 10% by weight based on the weight of the abrasive grain.

7. A method according to claim 1 in which the step of blending the sugar/starch particles into the components for making the abrasive article is the step of blending the sugar/starch particles with the vitreous bond material prior to blending the vitreous bond material with the abrasive grain and temporary binder.

8. The method of claim 1 wherein the abrasive grain is selected from the group consisting of fused alumina, sol-gel alumina, silicon carbide, cubic boron nitride and diamond abrasive grains.

9. The method of claim 1 in which at least two chemically different abrasive grains are employed.

10. An abrasive article produced in accordance with claim 1.

11. A grinding wheel produced in accordance with claim 3.

12. A grinding wheel produced in accordance with claim 8.

* * * * *